United States Patent [19]

Engelhard

[11] Patent Number: 4,580,414

[45] Date of Patent: Apr. 8, 1986

[54] REFRIGERATION SYSTEM

[76] Inventor: Friedrick R. Engelhard, P.O. Box 16933, Orlando, Fla. 32861

[21] Appl. No.: 765,682

[22] Filed: Aug. 15, 1985

[51] Int. Cl.[4] ..... F25B 1/00

[52] U.S. Cl. ..... 62/498; 417/310

[58] Field of Search ..... 62/115, 116, 498, 500; 417/310

[56] References Cited

U.S. PATENT DOCUMENTS

| | | | |
|---|---|---|---|
| 3,521,461 | 7/1970 | Granryd | 62/498 |
| 3,823,573 | 7/1974 | Cassady | 62/116 |
| 3,828,569 | 8/1974 | Weisgerber | 62/498 |
| 3,861,166 | 1/1975 | Goldsberry | 62/500 |
| 4,342,199 | 8/1982 | Shaw et al. | 417/310 |

*Primary Examiner*—Ronald C. Capossela

*Attorney, Agent, or Firm*—William M. Hobby, III

[57] ABSTRACT

A high-pressure refrigerant driven refrigeration apparatus has a heat exchanger charged with a refrigerant for transferring heat from a heat source to the refrigerant, and a refrigerant motor connected to the heat exchanger and powered by the heated high pressure refrigerant. A compressor is connected to the refrigerant motor and driven thereby. The system includes a condenser connected to the refrigerant motor and to the compressor for liquefying the refrigerant from the refrigerant motor and from the compressor and an evaporator connected to the compressor for receiving the expanded refrigerant from the compressor. The refrigerant motor may be a reciprocating or a rotary motor.

18 Claims, 4 Drawing Figures

TO HIGH PRESSURE REFRIGERANT GENERATOR
TO SYSTEM CONDENSER
START VALVE
REFRIGERATION SYSTEM DISCHARGE
REFRIGERATION SYSTEM SUCTION
HIGH PRESSURE REFRIGERANT SUPPLY
MOTOR EXHAUST TO CONDENSER
COMPRESSOR SUCTION
COMPRESSOR DISCHARGE
HIGH PRESSURE REFRIGERANT SUPPLY

REFRIGERATION SYSTEM

BACKGROUND OF THE INVENTION

The present invention relates to a refrigeration system, and especially to a refrigeration system designed to operate with energy supplied by heated fluids driving a refrigerant motor to operate a compressor.

In the past, it has been common to provide a great variety of refrigeration systems, especially for use in air-conditioning. These systems typically have a compressor to compress and liquefy the refrigerant in a condenser. The compressed refrigerant can be fed to an evaporator where a reduction in the pressure allows the refrigerant gas to expand into a gas thereby cooling an evaporator coil which can have air or other fluids blown thereby having heat removed therefrom to a space to be cooled. The evaporator feeds the expanded refrigerant back through the compressor. Compressors are normally electrically driven or belt driven by internal combustion engines but other types of cooling systems, such as obsorption systems, are also used in air conditioning.

The present system operates as a conventional air-conditioner or heat pump system having a compressor for compressing a refrigerant and connected to a condenser to liquefy the refrigerant from the compressor and having an evaporator connected to the compressor for receiving and expanding the refrigerant from the compressor for cooling an evaporator coil. The compressor in the present case is a refrigerant motor which may be an integral compressor and refrigerant reciprocating motor or alternatively a combined rotor refrigerant motor and compressor. A heat exchanger is used to collect heat from a heat source, such as wasted heat from a vehicle engine, into a refrigerant system for operating the refrigerant motor. The refrigerant motor can utilize the same condenser as that used by the compressor for liquefying the refrigerant for the refrigerant motor. Typical prior art patents dealing with refrigeration systems, include the Wood U.S. Pat. No. 2,986,898 for a Refrigeration system with a refrigerant operated pump and the Smeal U.S. Pat. No. 4,483,154 for a refrigerated air-conditioning system using a diaphram pump. This latter patent uses a dual refrigerating system in which a refrigerant diaphram pump drives a diaphram compressor for operating the refrigerant system. In addition to these patents, there have been numerous free piston type sterling engines working on external combustion sources for driving the engine pistons. There have also been a wide variety of rotary pumps and compressors as well as automobile engines which utilize an internal combustion engine's waste heat to perform a useful function. A rotary sterling engine can be seen in U.S. Pat. No. 3,492,818 while patents using waste heat from an automobile engine can be seen in U.S. Pat. No. 3,948,235 and in U.S. Pat. No. 2,737,014.

SUMMARY OF THE INVENTION

A refrigeration system includes a heat exchanger charged with a refrigerant for transferring heat from a heat source to the refrigerant and connected to an integral refrigerant motor and compressor. The refrigerant motor is connected to the heat exchanger and powered by the heated high pressure refrigerant for driving the compressor. The compressor is connected to a condenser for liquefying the refrigerant from the compressor. The condenser is also connected to a refrigerant motor for liquefying the refrigerant from the refrigerant motor. An evaporator is connected to the compressor for receiving the expanded refrigerant from the evaporator to thereby cool an evaporator coil. A refrigerant motor and compressor may be either a reciprocating piston motor or a rotary refrigerant motor compressor combination. The reciprocating cylinder motor compressor includes a cylinder housing forming a cylinder therein and a pair of sliding pistons connected to each other by a shaft and sliding in the cylinder. A sliding valve element is slidably mounted on the shaft between the pistons and is slidable between a pair of stock members on the wall of the cylinder. The valve element is ported for coupling a high-pressure refrigerant from the heat exchanger into the cylinder to drive one piston in one direction when the valve element is in one position and to drive the second piston in the opposite direction when the valve element is in the second position. The piston or shaft has an extension to move the valve element between the first and second positions responsive to the piston moving at a predetermined distance in each direction. A rotary refrigerant motor compressor combination includes a rotary compressor connected to a pair of rotary pistons having sliding vanes positioned 180 degrees from each other so that expanding refrigerant in the rotary motor is driving one or the other rotary pistons continuously to drive the rotary compressor.

BRIEF DESCRIPTION OF THE DRAWINGS

Other objects, features and advantages of the present invention will be apparent from the written description and the drawings in which.

DESCRIPTION OF THE PREFERRED EMBODIMENTS

Figure 1:
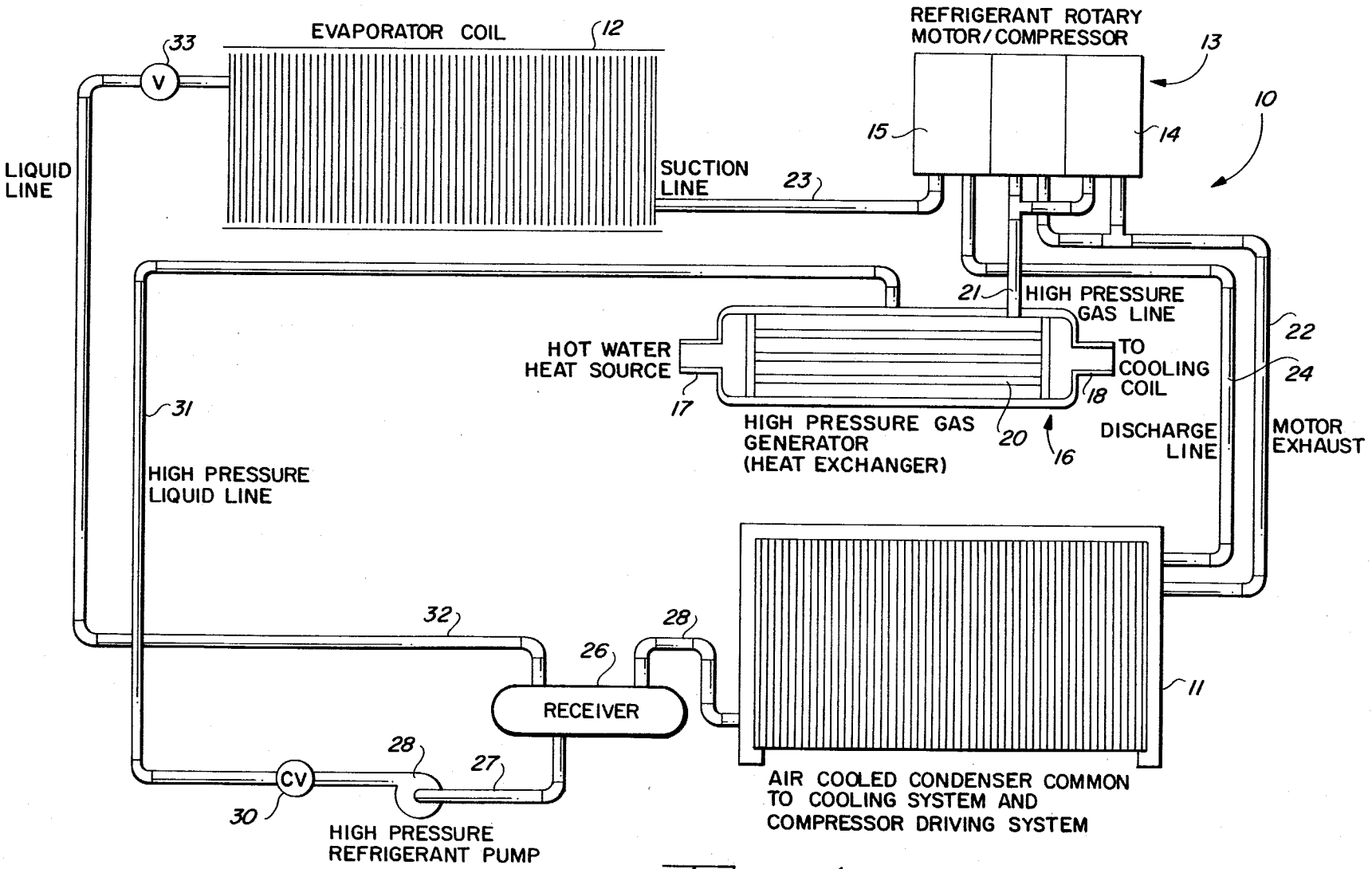
FIG. 1 is a schematic diagram of a refrigeration system in accordance with the present invention.

Referring to the drawings, and especially to FIG. 1, a refrigeration system 10 has an air cooled condenser 11 and an evaporator coil 12. A refrigerant motor compressor 13 includes a refrigerant motor portion 14 and a refrigerant compressor portion 15. A heat exchanger 16 has a source of fluid heat, such as hot water or hot air passing through an opening 17, over heat exchanger coils 20, and out an output 18. A high-pressure gas generator 16 heats the refrigerant therein with the heated fluid passing therethrough and is connected by a high-pressure refrigerant line 21 to the refrigerant motor 14 for driving the refrigerant motor. A refrigerant line 22 connects the refrigerant motor exhaust refrigerant to the air-cooled condenser 11 where the refrigerant is cooled then liquefied. The evaporator coil 12 is connected through a suction line 23 to the compressor 15 while a refrigerant line 24 is connected from the output of the compressor 15 to the air-cooled condenser 11. Liquid refrigerant passing out the condenser output line 25 is fed to a receiver 26. An output line 27 of receiver 26 passes through a high-pressure refrigerant pump 28 and through a check valve 30 and through a high-pressure liquid refrigerant line 31 into the heat exchanger 16 where it is heated and then passes through the exchanger 16 and out the output line 21 as a high pressure gas into the refrigerant motor 14 portion of the refrigerant motor compressor 13. The receiver 26 also has a liquid refrigerant line 32 connected through a valve 33 to the evaporator coil 12. The liquid refrigerant expands to vapor form in the evaporator coil 12 with the expansion of the refrigerant taking heat which is removed through the coil from the surrounding atmosphere, thereby cooling the coil and surrounding atmosphere. The vaporized refrigerant is fed through the suction line 23 back to the compressor. The refrigeration system as shown in FIG. 1 uses a standard component of a compressor condenser, receiver and evaporator coil. However, the refrigerant motor and the compressor use the same air-cooled condenser 11 and receiver 26 for cooling and liquefying the refrigerant. By using common components, leakage between the integrated refrigerant motor and compressor 13 will not harm the system. The refrigerant system 10 also has the addition of the heat exchanger 16 for converting sources of heat, such as waste heat from an automobile engine, to use for power by expanding the refrigerant therein for driving the refrigerant motor and compressor.

Figures 2, 3, 4:
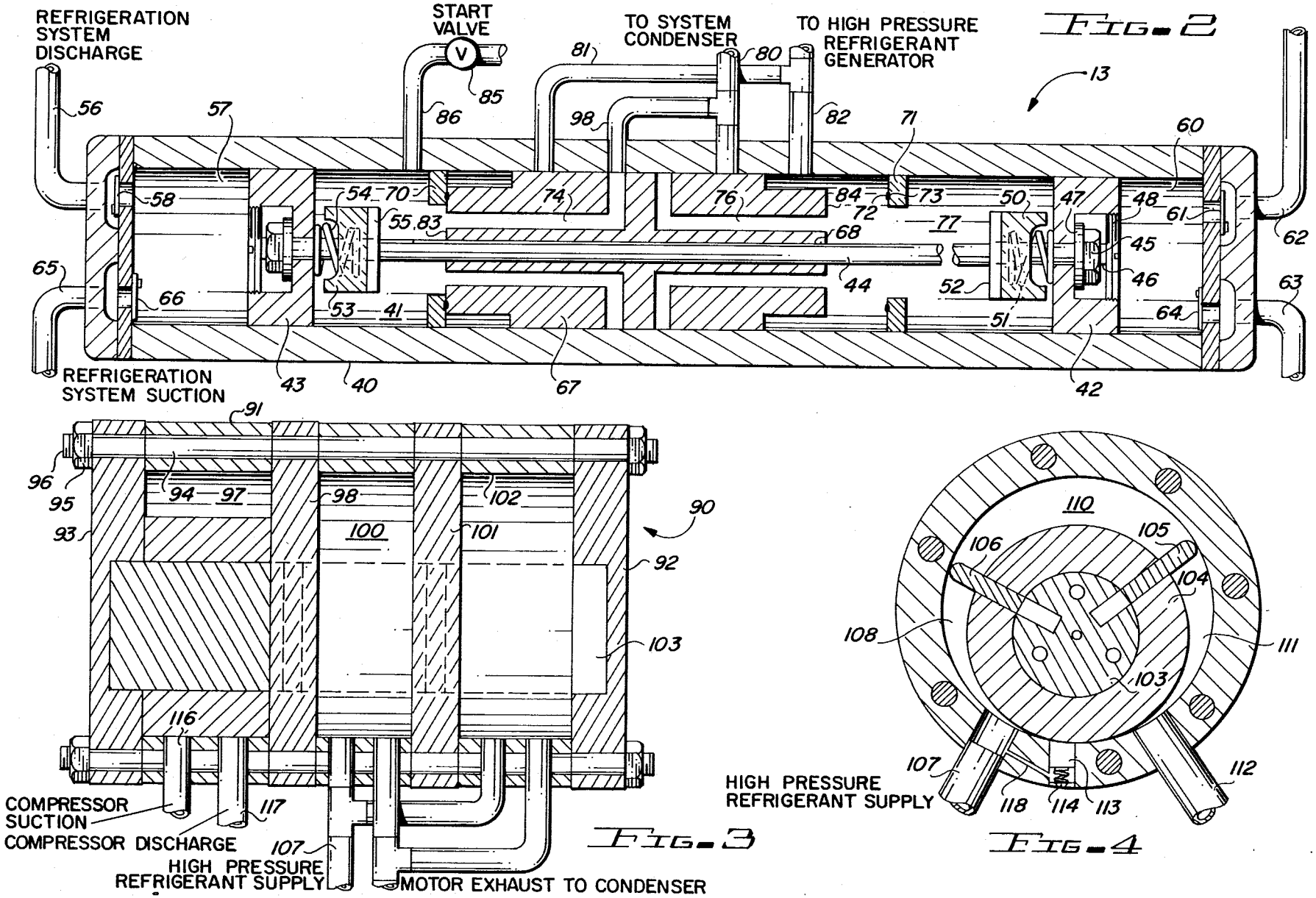
FIG. 2 is a sectional view of a refrigerant motor compressor for use in the system of FIG. 1.
FIG. 3 is a sectional view of a refrigerant motor compressor.
FIG. 4 is a sectional view taken on line 4—4 of FIG. 3.

FIG. 2 shows the motor compressor 13 as a combined reciprocating piston motor and compressor. The motor and compressor in accordance with this invention has a cylinder housing 40 forming a cylinder 41 therein having a pair of pistons 42 and 43 slidably mounted in the cylinder 41 and fixably connected to each other by a shaft 44. The shaft 44 is attached to each piston by a nut 45 threaded on a threaded end portion 46 of each end of the shaft 44 and tightened against the washer 47. An internally threaded opening 48 allows access to the nut and seals the top of the shaft 44 thereagainst when the cap is threaded thereinto. The piston 42 has a valve actuating member 50 springloaded with a spring 51 and having a driving surface 52 on the end thereof. Similarly, piston 43 has a valve driving piston member 53 supported against the spring 54 and having a contact surface 55. The pistons 42 and 43 slide back and forth in the cylinder 41 and when moved in one direction produce a refrigerant discharge under pressure by the force of the pistons through the line 56 with refrigerant passing from the cylinder portion 57 out the compressor discharge valve 58. The piston 42 drives the refrigerant from the cylinder portion 60, past the check valve 61 and out the refrigerant discharge line 62. Similarly, as the pistons move in the opposite direction, piston 42 sucks refrigerant from the line 63 through the compressor suction valve 64 into the cylinder portion 60, while the piston 43 draws refrigerant through the refrigerant suction line 65 through the check valve 66 into the cylinder portion 57. Thus, the movement back and forth of the pistons 42 and 43 act as a compressor for the refrigeration system alternately drawing in refrigerant and compressing the refrigerant out the discharge line. A sliding valve member 67 has a bore 68 therethrough and rides on shaft 44 as it slides back and forth between stops 70 on one end and 71 on the other end. The stops 70 and 71 may be annular stops having annular O-rings 72 mounted in annular grooves 73 to cushion the piston as it slides back and forth as well as to seal each end. The valve element 67 has a passageway 74 leading from the side of the valve element 67 into a cylinder portion 75 on one side of the piston 43 while a passageway 76 passes from the side of the valve element to a cylinder portion 77. In the valve element shown in FIG. 2, passageway 74 is connected through a line 78 to the condenser line 80. A high-pressure refrigerant generator line 81 is blocked by the sides of the valve element 67, but the high-pressure refrigerant line 82 is connected into the space 77 for driving the floating piston 42 from the back of the piston to compress the refrigerant in the cylinder portion 60. When the piston 42 approaches the end of the cylindrical portion 60 at the end of it's stroke, the face 55 of the piston portion 53 is pushed against the end of the valve element 67 to seal the opening 74 and to shove the valve element from the position illustrated against the stop 70 to the other end of the valve element against the stop 71 to block the line 78 from entering the cylinder portion 75. The high-pressure refrigerant is connected in this position to enter through line 81 into the cylinder chamber 75 to reverse the direction of the pistons 43 and 42. Similarly, the passageway 76 then aligns with the condenser line 80 to allow the espace of the refrigerant from the chamber 77 as the piston 42 is returned and draws more refrigerant through the line 63 into the chamber 60. This direction continues until the piston member 50 surface 52 abutts against the end 84 of the valve elements 67 to shift the valve elements 67 again in the opposite direction back against the stop 70. A start valve 85 is connected through a start line 86 to initially start the movement of the system. The high-pressure line 82 is connected to the heat exchanger 16 of FIG. 1 where it receives the high-pressure refrigerant for operating the refrigerant motor portion of the motor compressor 13.

It should be clear at this point that a motor compressor has been combined that once started will cause sliding piston compressor to continuously compress a refrigerant in an air-conditioning or other refrigerant system. The piston is valved through a sliding valve system which is automatic once the system is started, as long as the compressor and refrigerant motor is receiving the high-pressure refrigerant from the heat exchanger through the lines 82 and 81.

FIGS. 3 and 4 show an alternate embodiment of the refrigerant motor compressor combination 13 (FIG. 1) having the refrigerant motor combination 90 to replace 13 and having a rotary compressor motor housing 91 having end plates 92 and 93 bolted together with elongated bolts 94 with nuts 95 threaded on the threaded ends 96. The housing has a rotary compressor chamber 97 spaced by a wall 98 from the refrigerant motor chamber 100. The refrigerant motor 100 is spaced by spacing wall 101 from the second refrigerant motor chamber 102. A common central shaft 103 acts as the shaft for both refrigerant rotors motors 100 and 102 as well as the compressor 97. Each has a rotary portion 104 attached to the central shaft 103 and each has a pair of sliding vanes 105 and 106 forming a plurality of chambers. A high-pressure refrigerant supply line 107 enters both motor chambers 100 and 102 into the rotary chamber 108 to direct pressure against the vane 106 as the shaft 103 rotates. The chambers enlarge as the refrigerant applies pressure within chamber 110 against the sliding vane 105 as the expanding refrigerant drives the vanes 105 and 106 to rotate the shaft 103. Each vane 105 then drives the refrigerant in the chamber 111 out the motor exhaust line 112. The rotary compressor works in exactly the same fashion for the compressor chamber 97 except that the entering refrigerant is continuously compressed from the entering suction line out the compressor discharge valve 118 through the discharge line into the air-cooled condenser 11 of FIG. 1. The rotary compressor as shown in FIGS. 3 and 4 has a bar-seal 113 springloaded with a small spring 114 to seal the rotary compressor portion 104 against leakage of refrigerant thereby. A small vent 115 vents to high-pressure applying additional pressure in back of the bar-seal 113. The compressor will work at less efficiency without the bar seal.

In operation, high-pressure refrigerant from the heat exchanger enters line 107 into the pair of refrigerant motors 100 and 102 which motors have their vanes 105 and 106 placed 80 degrees apart or opposite with each other to provide a continuous force course from the expanding high-pressure refrigerant entering through lines 107 into each of the motors. The expanding high-pressure drives the vanes 105 or 106 and the compressor portion 104 to rotate the shaft 103 until the refrigerant passes out of the exhaust line 112. Rotation of the shaft 103 rotates the shaft in the compressor portion of the compressor refrigerant motor to compress refrigerant entering the compression suction line 116 which refrigerant is compressed by vanes similar to the vanes 105 and 106 and the compressed refrigerant is pushed out the compressor discharge line 117 back to the air cooled condenser 11 of FIG. 1.

It should be clear at this point that a refrigeration system has been provided for providing air-conditioning or other useful work from waste heat, or the like, and which utilizes a combined refrigerant motor and refrigerant compressor along with a heat exchanger for generating a high pressure refrigerant for actuating the refrigerant motor compressor combination. It should also be clear that the system utilizes a common condenser and receiver which further simplifies the system and reduces the problem of leakage of refrigerant between the compressor and refrigerant motor portions. It should also be clear that both a reciprocated refrigerant motor and compressor combination and a rotary motor and compressor combination have been provided. However, the present invention is not to be limited to the forms shown which are to be considered illustrative rather than restrictive.

I claim:

1. A refrigeration system comprising in combination:

a heat exchanger charged with a refrigerant for transferring heat from a heat source to the refrigerant;

refrigerant motor means connected to said heat exchanger and powered by the heated refrigerant;

a compressor connected to said refrigerant motor means and driven thereby;

condenser means connected to said refrigerant motor means and to said compressor for liquefying the refrigerant from the refrigerant motor means and from the compressor;

evaporator means connected to the compressor for receiving the expanded refrigerant from the compressor to thereby cool an evaporator coil;

the refrigerant motor means and compressor forming an integrated unit having:

a cylinder housing forming a cylinder therein;

a pair of free sliding pistons connected to each other by a shaft in the cylinder;

a sliding valve element slidably mounted on the shaft between the pistons and slidable between a pair of stop members, said valve element being ported for coupling high-pressure refrigerant from said heat exchanger into said cylinder to drive one said piston in one direction when said valve element is in one position and to drive the second piston in the opposite direction when said valve element is in a second position; and means to move the valve element between said one and said second positions responsive to said pistons moving at a predetermined distance in each direction, whereby a refrigerant system is driven by refrigerant motor and compressor combination.

2. A refrigeration system in accordance with claim 1 in which each of said pair of annular stop members has an O-ring mounted thereon for sealing the slide valve member thereagainst.

3. A refrigeration system in accordance with claim 2 in which the condenser means is a single air cooled condenser for condensing the refrigerant from the motor means and from the compressor.

4. A refrigeration system in accordance with claim 3 in which a condenser means is connected to a single receiver for supplying refrigerant to both the evaporator means and the heat exchanger.

5. A refrigeration system in accordance with claim 4 including a high pressure refrigerant pump connected between the receiver and the heat exchanger for transferring the heat from a heat source to the refrigerant to place the heat exchanger refrigerant under high pressure.

6. A refrigeration system in accordance with claim 5 in which a check valve is positioned in the line between the high pressure refrigerant pump and heat exchanger.

7. A refrigeration system in accordance with claim 6 in which said refrigerant motor means and compressor includes a starting valve connected to a starter line connected to the cylinder housing for initially actuating the sliding valve element.

8. A refrigeration system in accordance with claim 7 in which the refrigerant motor means and compressor means to move the valve element between positions include a valve pushing element mounted on the shaft connecting the pair of free-sliding pistons and is spring cushioned adjacent each free-sliding piston for protruding through a stop member to thereby push against the sliding valve element when the free-sliding piston is moving in one direction.

9. A refrigeration system in accordance with claim 8 in which each said free-sliding piston is attached to the shaft in the cylinder with a nut threaded onto the end of the shaft.

10. A refrigeration system in accordance with claim 9 in which each free-sliding piston has a countersunk portion therein with a threaded shaft end extending through the piston thereinto and the nut being threaded thereon in the countersunk portion and each said piston has a threaded cap covering the countersunk portion in the piston.

11. A refrigeration system in accordance with claim 10 in which the sliding valve element is cylindrical in shape and has annular reduced portions on either end thereof for opening the high pressure refrigerant line between the valve element and the back side of one sliding piston when the valve element is in one position and to open the high pressure refrigerant line between the other piston and the other end of the valve element when the valve element is in a second position.

12. A refrigeration system comprising in combination:

a heat exchanger charged with a refrigerant for transferring heat from a heat source to the refrigerant;

refrigerant motor means connected to said heat exchanger and powered by the heated refrigerant;

a compressor connected to said refrigerant motor means and driven thereby;

condenser means connected to said refrigerant motor means and to said compressor for liquefying the refrigerant from the refrigerant motor means and from the compressor;

evaporator means connected to the compressor for receiving the expanded refrigerant from the compressor to thereby cool an evaporator coil;

the refrigerant motor means and compressor forming an integrated unit having:

a rotary compressor and rotary refrigerant means housing having a plurality of chambers formed therein and a single shaft extending therethrough;

a rotary compressor rotor attached to the rotary shaft in one housing chamber for rotation on the shaft and having at least one sliding vane therein for drawing in refrigerant from a compressor suction line and discharging the compressed refrigerant; and a refrigerant motor rotor attached to the rotary shaft in a second chamber and having at least one vane therein which vane is driven by a high pressure refrigerant supply line to rotate the refrigerant motor rotor until the refrigerant escapes through the refrigerant motor exhaust line.

13. A refrigeration system in accordance with claim 12 in which said refrigerant motor has a pair of refrigerant motor chambers each having a refrigerant motor rotor mounted to said shaft in said housing.

14. A refrigeration system in accordance with claim 12 in which the refrigerant motor has a pair of sliding vanes mounted in the refrigerant motor rotor.

15. A refrigeration system in accordance with claim 14 in which each refrigerant motor rotor has a pair of sliding vanes therein.

16. A refrigeration system in accordance with claim 15 in which each rotor is mounted to the rotary shaft off center for creating an expanding and compressing chambers as said rotor elements rotate with said sliding vanes therein.

17. A refrigeration system in accordance with claim 16 in which the refrigerant motor has a spring loaded bar seal mounted in the housing for pressing against the motor rotor for sealing between the high pressure refrigerant supply line and the refrigerant motor exhaust line.

18. A refrigeration system in accordance with claim 17 in which a vent connects the refrigerant motor high pressure refrigerant supply line to the back of the motor bar seal for driving the bar seal against the rotor by the refrigerant pressure.

* * * * *